US006302640B1

(12) United States Patent
McKelvey

(10) Patent No.: US 6,302,640 B1
(45) Date of Patent: Oct. 16, 2001

(54) AXIAL FAN SKIP-STALL

(75) Inventor: Wilfred G. McKelvey, Palos Verdes, CA (US)

(73) Assignee: AlliedSignal Inc., Morristown, NJ (US)

( * ) Notice: Subject to any disclaimer, the term of this patent is extended or adjusted under 35 U.S.C. 154(b) by 0 days.

(21) Appl. No.: 09/438,032

(22) Filed: Nov. 10, 1999

(51) Int. Cl.[7] ..... F04D 5/00
(52) U.S. Cl. ..... 415/58.5; 415/58.7; 415/57.4
(58) Field of Search ..... 415/58.5, 58.7, 415/58.6, 57.4, 186, 208.5, 211.1

(56) References Cited

U.S. PATENT DOCUMENTS

| | | | | |
|---|---|---|---|---|
| 3,189,260 | | 6/1965 | Ivanov . | |
| 4,602,410 | | 7/1986 | Karlsson et al. . | |
| 4,630,993 | * | 12/1986 | Jensen | 415/58.7 |
| 4,673,331 | * | 6/1987 | Kolb | 415/58.7 |
| 4,871,294 | * | 10/1989 | Ivanov et al. | 415/58.7 |
| 4,990,053 | | 2/1991 | Rohne . | |
| 5,230,605 | | 7/1993 | Yamaguchi et al. . | |
| 5,551,841 | | 9/1996 | Kamada . | |
| 5,607,284 | | 3/1997 | Byrne et al. . | |
| 5,762,470 | * | 6/1998 | Gelmedov et al. | 415/57.4 |

OTHER PUBLICATIONS

Ziabasharhagh, M., et al., Presentation at the Intern'l Gas Turbine and Aeroengine Congress and Exposition, 1992, Germany.

* cited by examiner

*Primary Examiner*—F. Daniel Lopez
*Assistant Examiner*—James M McAleenan
(74) *Attorney, Agent, or Firm*—William J. Zak, Jr. Esq.

(57) ABSTRACT

An axial fan includes a hub within a housing. A cavity is formed between the hub and housing. A plurality of blades is on the hub, with an air separator ring disposed operatively adjacent to the blades. The ring supports a plurality of vanes that are longitudinally aligned with the blades. A diverter is disposed operatively adjacent to the vanes so that the diverter directs a skip-stall air flow about the ring.

24 Claims, 3 Drawing Sheets

AXIAL FAN SKIP-STALL

BACKGROUND OF THE INVENTION

The present invention generally relates to axial fans and, more particularly, provides an effective method of reducing unstable stall flow characteristics for the full range of axial fans, including axial fans with hub diameters that are 50 to 90% of the impeller blade tip diameter.

Stall originates when the air cannot accommodate itself to the suction surface of a blade and the air separates from the blade. There are several types of stall that can occur in an axial fan. One type is blade stall that occurs at the hub or blade tip. Typically, stall first occurs at the tip. A stall cell is initiated by reducing the airflow through an impeller below its original design conditions, thereby increasing the air incidence angle into the blade. A stall cell typically occurs when the blade incidence angle exceeds about 8 to 15 degrees. For purposes of illustration, and in the context of three blades A, B, and C, blade B may stall. Substantial cell blockage occurs between blades B and C. Due to the blockage, inlet flow is diverted away from the inlet to B and towards C. The result is an increased angle of attack on C and a reduced angle of attack on A. Since C was on the verge of stalling, it will now stall, whereas A will have less of a tendency to stall.

The above breakdown of the flow into stalled and unstalled sectors or cells is called rotating stall. The stalled cells have low axial velocity, or even negative velocity, whereas the unstalled cells operate at a level of axial velocity consistent with unstalled flow. The stall cell will then propagate along the blade row in the direction of rotation.

There may be one or more rotating stall cells which propagate around the circumference of the impeller with a constant rotational speed, usually between 20 to 70% of the rotor speed. In the cells, the blades are severely stalled. Typically, there is negligible net through-flow with areas of local reverse flow. The cell can vary from covering only part of a blade to over 180 degrees of the annulus. The inception of rotating stall occurs at the peak (zero slope point) of the pressure curve.

In a case type of stall, as the fan approaches stall, the centrifuged low momentum air and reverse airflow build up at the impeller tip and stall the tip.

Efforts to minimize or eliminate stall have been many in the past. For example, U.S. Pat. No. 5,551,841 discloses an axial fan for a hair dryer that seeks to reduce the leakage swirl at the outer peripheral tip edges of the vanes. The fan includes an outer casing and a coaxially telescoping inside wall member, which together form an annular flow path between them. The annular flow path communicates with a second inlet port that is separate from a first inlet port that receives a main air into the fan. The annular flow path is upstream of the vanes of the fan and separate from the main air path. The peripheral air flows through the annular flow path and is directed towards the outer peripheries of the vanes to prevent leakage swirl at the tips of the vanes. Disadvantages, however, include the fact that reducing the backflow leakage at the blade tip does not have any influence on rotating stall cells. This device evidently only works in applications where the fan is blowing into a duct or plenum. The natural leakage path through the annular flow path entrance prohibits this device from being used on a closed loop system or a system where the fan is exhausting from a duct or plenum.

In a past attempt at reducing stall in the context of an axial flow gas turbine high compressor, U.S. Pat. No. 5,607,284 provides an abradable tip shroud assembly intended to address the problem of reduced axial momentum at the blade tips, but with reduced manufacturing costs. The assembly includes an annular shroud extending circumferentially about the longitudinal axis. The annular shroud comprises a plurality of shroud segments having first and second arcuate members with a baffle fixed between them. A layer of an abradable material is positioned intermediate the arcuate members and the blade tip. The arcuate members form a passage that extends from a position radial to the tip of a blade, past the baffle, and then to a position forward of the blade. While providing advantages, some of the disadvantages include an expensive method of stall treatment with only minimal stall improvement. This patent is focused on controlling blade tip gap as the main means of controlling stall. The location of the annular stall cavity and its size, in respect to the axial length of the blade tip, are the main reasons this device only provides minimal rotating stall improvement. The straight baffle in the return air path only provides structural support. The baffle does not recover any of the swirl energy from the air flowing leaving the blade and going through the treatment area.

In U.S. Pat. No. 5,230,605, a prior art air separator in an axial flow blower was described as having a ring supporting a straightening vane, both of which were forward of a rotor vane. A stall zone occurring at the tip of the rotor vane was sucked into a rotor vane tip opening of the housing. The vane tip opening was located radial to and upstream of the rotor vane. The swirling motion of the sucked air was eliminated as it passed through the straightening vane that was disposed in the vane tip opening. The air was then returned to the main air at a position upstream of the rotor vane. The improvement to the prior art design included the straightening vane at a rearward area of the ring. An inlet guide vane was added at the ring and upstream of the rotor vane, whereby the guide vane could be rotated about an axis perpendicular to the longitudinal axis. Some of the disadvantages of this design include the need for an additional fan inlet guide vane. This type of treatment appears to only provide minimal stall improvement for fans with high hub-to-tip ratios of about 50% or less. Due to stall cavity vane location and shape, only minimal recovery (i.e., about 50%) of swirl energy in the air going through the stall cavity is achieved. The amount of blade exposure and the lack of an impeller tip seal are additional reasons this device is ineffective on high hub-to-tip ratio fans.

The axial fan in U.S. Pat. No. 4,871,294 is somewhat akin to the prior art design mentioned in U.S. Pat. No. 5,230,605. The housing forms an annular chamber upstream of the rotor blades and that allows a stalled air to flow from the rotor blade tips and back into a main air upstream of the blades. Also upstream of the rotor blades is a ring that supports at its upstream portion guide vanes within the annular chamber. Disadvantages in this design include minimal rotating stall improvement for fans with high hub-to-tip ratios. The stall cavity vane location and shape only provide minimal recovery (i.e., about 50%) of swirl energy in the air going through the stall cavity. The amount of blade exposure, the lack of an impeller tip seal, and the lack of a diverter are additional reasons this device is ineffective on high hub to tip ratio fans.

Other related art is found in U.S. Pat. Nos. 4,673,331; 4,630,993; 4,602,410; and 3,189,260; as well as M. Ziabasharhagh et al., Presentation at the Intern'l Gas Turbine and Aeroengine Congress and Exposition, Germany (1992).

As can be seen, there is a need for an improved axial fan. Another need is for an axial fan and method that minimizes air stall characteristics. A further need is for an axial fan and method that recirculates an air stall flow back into a main air flow. Also needed is an axial fan and method that reduces air stall cell zones in a simple yet efficient fashion.

SUMMARY OF THE INVENTION

In one aspect of the present invention, an axial fan comprises a housing; a hub within the housing; a cavity formed between the hub and housing; a plurality of blades on the hub; an air separator ring disposed about the blades; a ring disposed operatively adjacent to said blades; a plurality of vanes supported by the ring, with the vanes being longitudinally aligned to the blades; and a diverter disposed operatively adjacent to the vanes, with the diverter directing a skip-stall air flow about the ring.

In another aspect of the present invention, a method of minimizing unstable stall characteristics of an axial fan comprises the steps of: channeling a skip-stall air flow into a cavity that is disposed at least partially forward of a blade on a hub of the fan; moving the skip-stall air flow past a vane that is longitudinally aligned to the blade; separating the skip-stall air flow from a main air flow into the fan; directing the skip-stall air flow forward of the blade; and re-directing the skip-stall air flow to the forward edge of the blade.

These and other features, aspects and advantages of the present invention will become better understood with reference to the following drawings, description and claims.

DETAILED DESCRIPTION OF THE INVENTION

Figure 1:
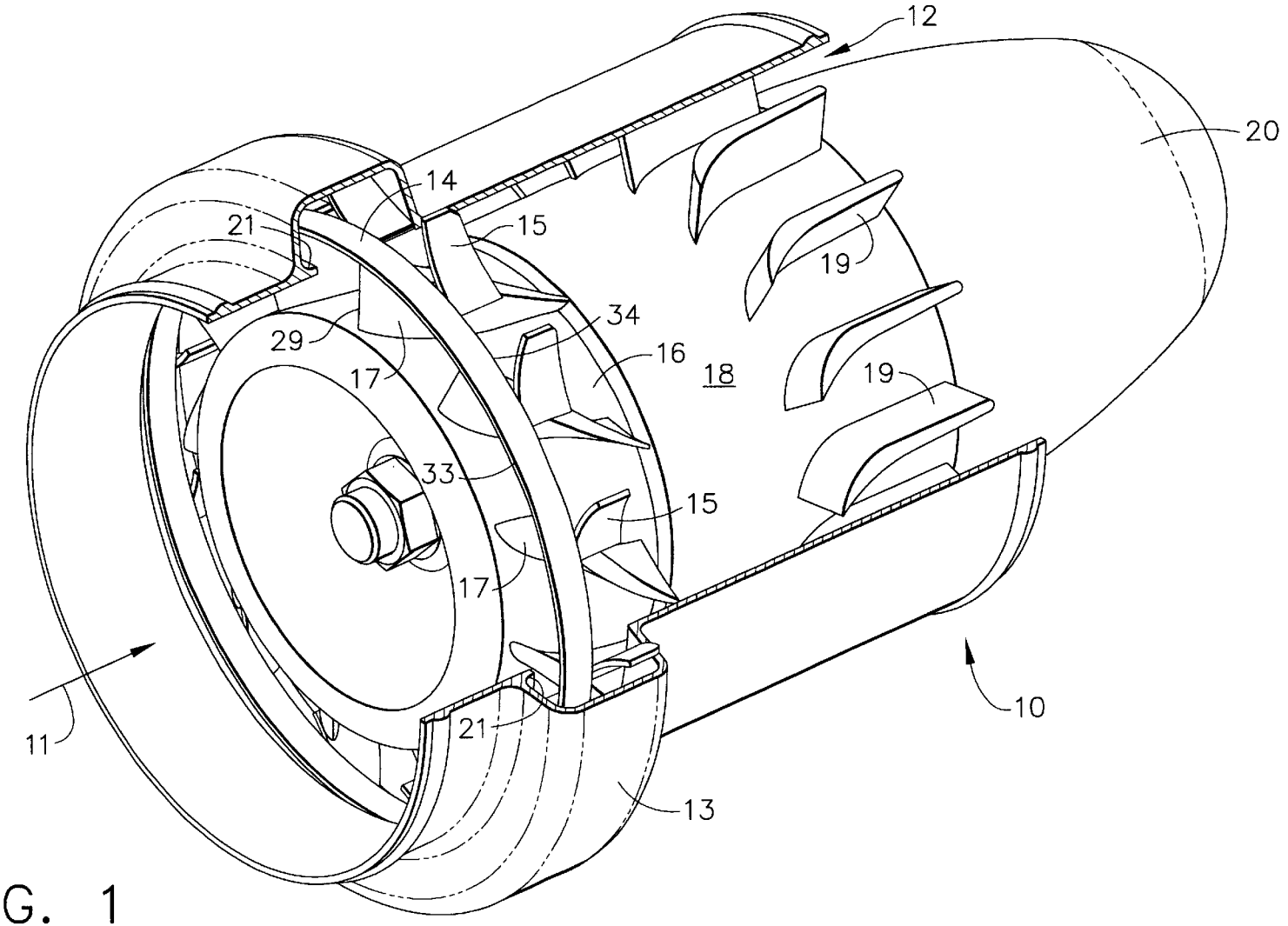
FIG. 1 is a perspective view partially cut away of a fan according to an embodiment of the present invention.

FIG. 1 depicts an axial fan 10 according to one embodiment of the present invention. The fan 10 provides a passive method of reducing pressure build-up at the tips 25 of blades 17 caused by rotating stall-cell blockage build up. The fan 10 includes an inlet that receives a main air flow 22 and an outlet 12 that expels the main air flow 22. A tail cone 20 is disposed at the outlet 12 and encloses a motor (not shown) that drives the fan 10.

Figure 2:
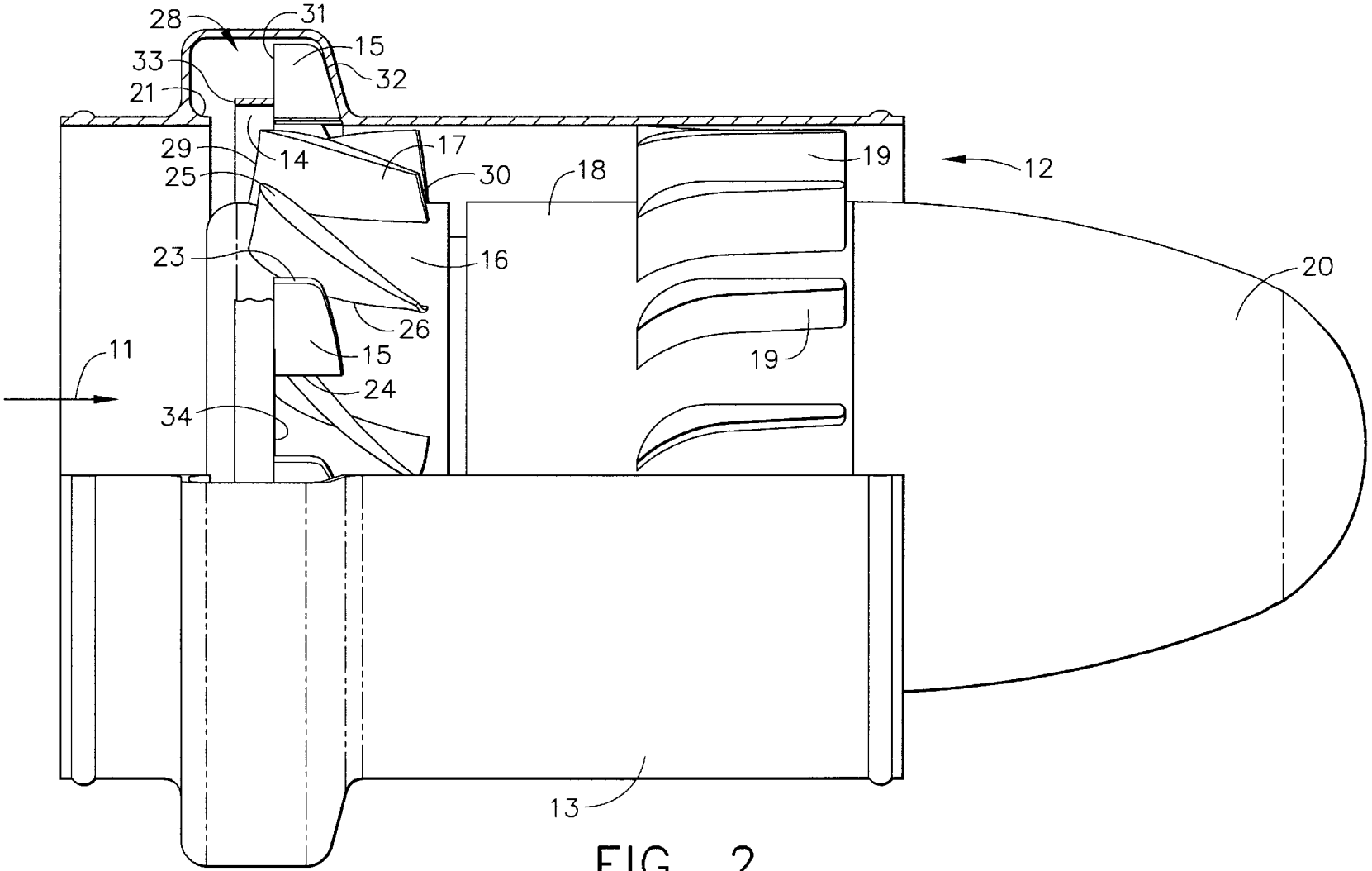
FIG. 2 is a side view partially cut away of the fan in FIG. 1.

A housing 13 encloses a stationary center body 18 disposed coaxial to and forward or upstream of the tail cone 20. The center body 18 supports a plurality of second or de-swirl vanes 19. A rotating hub 16 is coaxial to and forward of the center body 18. The hub 16 supports around its circumference a plurality blades 17. As better seen in FIG. 2, the blades 17 include an outside edge or tip 25 that is disposed away from the hub 16 and an inside edge or heel 26 disposed adjacent the hub 16. Each blade 17 further includes a forward or upstream edge 29 that faces the inlet 11 and a rearward or downstream edge 30 that faces the outlet 12.

Longitudinally aligned with the blades 17 is a non-rotating flow separator ring 14 that partially overlaps the forward edge 29 of the blades 17 and also extends upstream of the forward edge 29 of the blades 17. More specifically, the ring 14 is disposed radially about the blades 17. So positioned, a forward or upstream edge 33 of the ring 14 is adjacent to but upstream of the forward edges 29 of the blades 17. The ring 14 supports at its rearward or downstream edge 34 a plurality of first or skip-stall vanes 15.

The skip-stall vanes 15 include an outside edge or tip 23 that faces away from the ring 14 and an inside edge or heel 24 that is fixed to the ring 14. The skip-stall vanes 15 further include a forward or upstream edge 31 that faces the inlet 11 and a rearward or downstream edge 32 that faces the outlet 12. Being fixed to the ring 14, the skip-stall vanes 15 are thus disposed radially about or overlapping the blades 17, as well as being longitudinally aligned with the blades 17. Thereby, the upstream edge 31 of the vanes 15 are operatively adjacent the upstream edge 29 of the blades 17.

Figure 3:
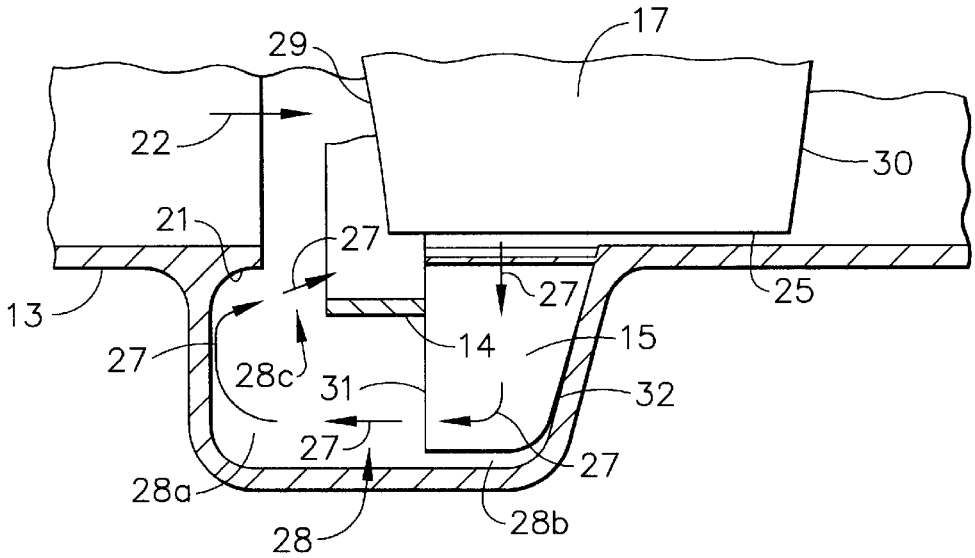
FIG. 3 is a diagram of a portion of the fan in FIG. 2 showing the movement of a skip-stall airflow according to an embodiment of the present invention.

The skip-stall vanes 15 are disposed in or surrounded by a cavity 28 that is formed between the housing 13 and the ring 14. Accordingly, the cavity 28 is positioned radially about the ring 14, the skip-stall vanes 15, and the blades 17. Preferably, about 50 to 80% of the axial lengths of the blades 17 are exposed to the cavity 28. The cavity 28 includes a vaneless region **28*a* that is located upstream of the vanes 15 and a vaned region 28*b* in which the vanes 15 are positioned. As can be seen in FIG. 3, the cavity 28 therefore channels a skip-stall air flow 27 from the tip 25 of the blades 17, into the vaned region 28*b*, past the upstream edge 31 of the vanes 15, and through the vaneless region 28*a*. The skip-stall air flow 27 next flows around the ring 14, exits the cavity 28 at a cavity outlet 28*c*, and then moves towards the upstream edge 29 of the blades 17. While moving towards the blades 17, the skip-stall air flow 27 mixes with the main air flow 22**.

A diverter 21 is in the form of a lip or ridge that is forward or upstream of the cavity outlet **28*c*. The diverter 21 diverts the skip-stall air flow 27 towards the blades 17, as opposed to the center of the hub 16 from which the blades 17 extend. In so doing, the efficiency of the fan 10** is increased.

For those skilled in the art, it can be understood that the present invention also provides a method of minimizing unstable stall characteristics of an axial fan. The cavity 28 allows the skip-stall air flow 27 to be released from the blades 17. The skip-stall vanes 15 channel or direct the skip-stall air flow 27 away from the tip 25 of the blades 17. At the same time, the vanes 15 are aerodynamically matched to the blades 17. Such matching is achieved by proper alignment of blade exit to vane entrance fluid angles, as is known in the art. So matched, the vanes 15 can recover about 85 to 90% of the swirl energy in the air leaving the blades 17. Swirl energy is the kinetic energy generated by the high blade 17 tangential velocity and the skip-stall airflow 27 coming off of the blade 17 outer edge 25. The ring 14 separates the skip-stall air flow 27 from the main air flow 22, and the skip-stall air flow 27 moves through the vaneless region **28*a* of the cavity 28 that is upstream of the blades 17. Upon the skip-stall air flow 27 moving through the cavity 28 and around the ring 14, the flow 27 is re-directed towards the forward edge 29 of the blades 17. As the skip-stall air flow 27 moves towards the blades 17, the flow 27 combines with the main air flow 22**.

Figure 4:
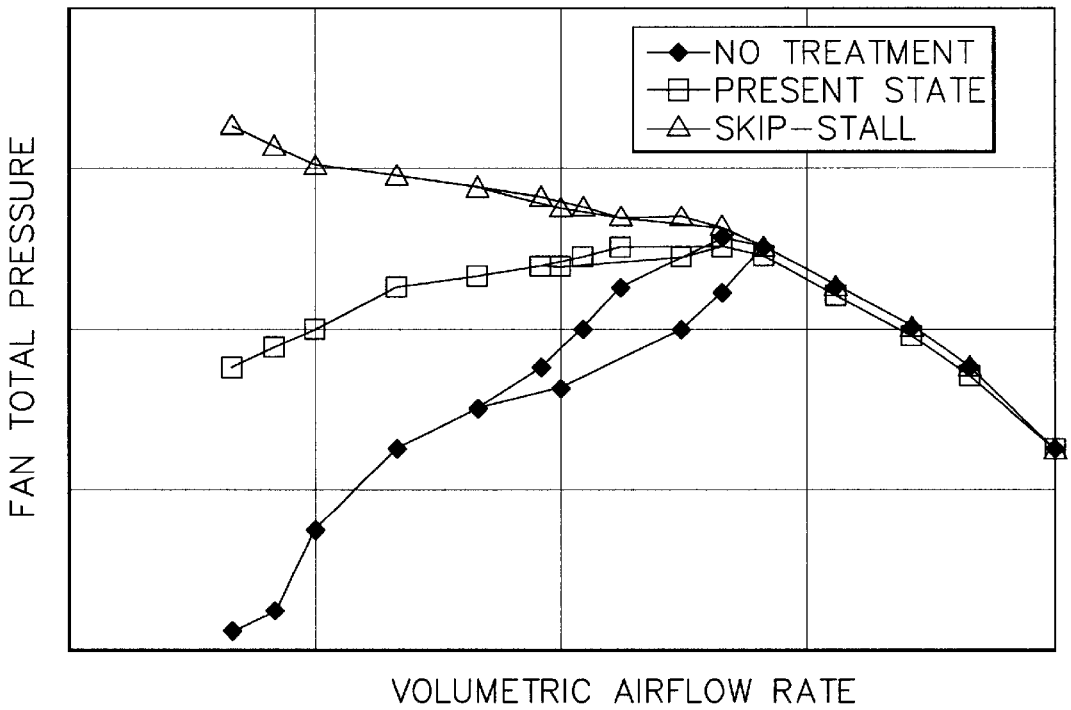
FIG. 4 is a graph of pressure versus volume of a fan according to the present invention and another fan of a prior art design.

The energy recovery provided by the present invention is a significant advantage over the prior art designs. Also, locating the vanes 15 radially to the blades 17 provides greater efficiency in comparison the prior art designs, particularly for fans having a hub-to-tip ratio greater than about 60%. An example of the greater efficiency is depicted in FIG. 4 wherein three fan designs are graphically compared by fan pressure versus volumetric air flow. The three fans include a known baseline axial fan without anti-stall treatment. Another fan is a current state-of-the-art design, such as that shown in U.S Pat. No. 4,871,294. The third fan includes the skip-stall treatment of the present invention. FIG. 4 shows how the present invention stabilizes the airflow through the blades with significant increases in flow range, but without appreciable loss in pressure rise or increase in power (efficiency). The known baseline fan also has a very pronounced hysteresis loop, which is not seen in the present invention. The state-of-the-art fan shows lower performance when compared to the present invention.

As can be appreciated by those skilled in the art, the present invention provides an improved axial fan. Also provided is an axial fan and method that minimizes air stall characteristics. Further provided is an axial fan and method that recovers skip-stall swirl energy coming off of the blades. The present invention also provides an axial fan and method that reduces air stall zones in a simple yet efficient fashion.

It should be understood, of course, that the foregoing relates to preferred embodiments of the invention and that modifications may be made without departing from the spirit and scope of the invention as set forth in the following claims.

What is claimed is:

1. An axial fan, comprising:

a housing;

a hub within said housing;

a blade on said hub;

an air separator ring disposed radially about said blade;

a vane positioned intermediate said ring and housing; and a cavity formed between said housing and ring, said cavity channels a skip-stall air flow from an outside edge of said blade and to an forward edge of said blade.

2. The fan of claim 1, further comprising a diverter operatively disposed adjacent said ring.

3. The fan of claim 1, wherein said ring supports said vanes.

4. The fan of claim 1, wherein a portion of said ring is disposed forward of said blade.

5. The fan of claim 1, wherein said vane is longitudinally aligned with said blade.

6. An axial fan, comprising:

a housing;

a hub within said housing;

a plurality of blades on said hub;

an air separator ring disposed about said blades;

a plurality of vanes supported by said ring, said vanes being positioned intermediate said ring and housing; and a diverter operatively disposed adjacent said vanes, said diverter directs a skip-stall air flow from a forward edge of at least one of said vanes and to a forward edge of at least one of said blades.

7. The fan of claim 6, further comprising a cavity formed between said housing and hub.

8. The fan of claim 7, wherein said cavity is disposed radially to at least one of said blades.

9. The fan of claim 6, wherein said diverter is disposed forward of said ring.

10. The fan of claim 6, wherein said ring is disposed adjacent a forward edge of at least one of said vanes.

11. The fan of claim 6, wherein said ring is disposed adjacent a forward edge of at least one of said blades.

12. An axial fan, comprising:

a housing;

a hub within said housing;

a cavity formed between said hub and housing a plurality of blades on said hub;

an air separator ring disposed operatively adjacent to said blades;

a plurality of vanes supported by said ring, said vanes being longitudinally aligned with said blades; and a diverter disposed operatively adjacent to said vanes, said diverter directs a skip-stall air flow about said ring.

13. The fan of claim 12, wherein said cavity is disposed radially to at least one of said vanes.

14. The fan of claim 12, wherein said cavity surrounds at least one of said vanes.

15. The fan of claim 12, wherein said cavity is operatively adjacent a forward edge of at least one of said blades.

16. The fan of claim 12, wherein a forward edge of at least one of said vanes is disposed adjacent a forward edge of at least one of said blades.

17. The fan of claim 12, wherein said ring interfaces said vanes and blades.

18. The fan of claim 12, wherein said ring separates a main air flow into said fan from a skip-stall air flow generated within said fan.

19. A method of minimizing unstable stall characteristics of an axial fan, comprising the steps of:

releasing a skip-stall air flow from a blade of said fan;

channeling said skip-stall air flow by a vane located radially to said blade; and directing said skip-stall air flow to a forward edge of said blade.

20. The method of claim 19, further comprising the step of separating a main air flow into said fan from said skip-stall air flow within said fan.

21. The method of claim 19, further comprising the step of moving said skip-stall air flow through at least a portion of a cavity that is disposed forward of said blade.

22. The method of claim 19, wherein the step of releasing said skip-stall air flow releases said flow adjacent an outer edge of said blade.

23. The method of claim 19, wherein the step of directing said skip-stall air flow combines said skip-stall air flow with a main air flow to said blade.

24. A method of minimizing unstable stall characteristics of an axial fan, comprising the steps of:

channeling a skip-stall air flow into a cavity that is disposed at least partially forward of a blade on a hub of said fan;

moving said skip-stall air flow past a vane that is longitudinally aligned with said blade;

separating said skip-stall air flow from a main air flow into said fan;

directing said skip-stall air flow forward of said blade; and re-directing said skip-stall air flow to said forward edge of said blade.

* * * * *